US006814136B2

(12) United States Patent
Yi et al.

(10) Patent No.: US 6,814,136 B2
(45) Date of Patent: Nov. 9, 2004

(54) PERFORATED TUBE FLOW DISTRIBUTOR

(75) Inventors: Chin Won Yi, Westland, MI (US); Kevin Bennett Wise, Connersville, IN (US); Christopher Lawrence Koppen, Livonia, MI (US); Albert Allen Rogier, Batesville, IN (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 10/214,243

(22) Filed: Aug. 6, 2002

(65) Prior Publication Data

US 2004/0026072 A1 Feb. 12, 2004

(51) Int. Cl.[7] ..... F28D 1/03
(52) U.S. Cl. ..... 165/153; 165/174; 165/176
(58) Field of Search ..... 165/153, 174, 165/109.1, 176

(56) References Cited

U.S. PATENT DOCUMENTS

| | | | | |
|---|---|---|---|---|
| 3,976,128 A | * | 8/1976 | Patel et al. | 165/153 |
| 4,153,106 A | | 5/1979 | Sonoda et al. | |
| 4,217,953 A | | 8/1980 | Sonoda et al. | |
| 5,651,268 A | * | 7/1997 | Aikawa et al. | 62/525 |
| 5,806,586 A | * | 9/1998 | Osthues et al. | 165/174 |
| 5,901,785 A | | 5/1999 | Chiba et al. | |
| 5,934,367 A | | 8/1999 | Shimmura et al. | |
| 6,161,616 A | * | 12/2000 | Haussmann | 165/176 |
| 6,199,401 B1 | | 3/2001 | Haussmann | |
| 6,484,797 B2 | * | 11/2002 | Saito et al. | 165/153 |

FOREIGN PATENT DOCUMENTS

| | | |
|---|---|---|
| GB | 2 078 361 | 1/1982 |
| JP | 3-260567 | 11/1991 |
| JP | 9-166368 | 6/1997 |
| JP | 9-196595 | 7/1997 |
| JP | 10-267462 | 10/1998 |
| WO | WO 02/103263 | 12/2002 |

* cited by examiner

*Primary Examiner*—Allen J. Flanigan
(74) *Attorney, Agent, or Firm*—Brinks Hofer Gilson & Lione

(57) ABSTRACT

An evaporator for conducting a heat exchanger between a refrigerant and ambient air including a plurality of refrigerant tubes, at least two header tanks in fluid communication with the plurality of refrigerant tubes and at least one of the heater tanks having a plurality of serrations through which refrigerant flows into each of the plurality of refrigerant tubes and a plurality of fins dispersed between each of the plurality of refrigerant tubes.

13 Claims, 4 Drawing Sheets

PERFORATED TUBE FLOW DISTRIBUTOR

TECHNICAL FIELD

The present invention relates to heat exchangers for use in automobile air conditioning circuits and to configurations for improving refrigerant distribution through the heat exchanger.

BACKGROUND

Automotive heat exchangers or evaporators include a plurality of refrigerant tubes connected typically to two headers or tanks. One header has an inlet for receiving refrigerant while the other header has an outlet for evacuating refrigerant from the evaporator. Heat dissipation fins are disposed between the refrigerant tubes to facilitate heat exchange between the evaporator and the ambient air.

In operation, refrigerant flows into the inlet through the refrigerant tubes where heat contained within the ambient air is exchanged with the refrigerant, thereafter the refrigerant leaves the evaporator through the outlet. Inertial and gravitational forces in the headers of the evaporator separate the liquid from the vapor phase of the refrigerant causing a mal-distribution of the liquid phase throughout the heat exchanger tubes. Consequently, a number of the refrigerant tubes will dry out prematurely and then superheat. The superheated refrigerant reduces heat transfer from the ambient air to the refrigerant. Furthermore, the refrigerant tubes containing single phase vapor have a heat transfer coefficient that can be three times lower than the corresponding two-phase (i.e. liquid/vapor) flow conditions. Uniform two-phase flow distribution can improve heat transfer rates up to thirty percent as compared to a completely separated single phase flow and in turn improve performance of the evaporator reducing the overall power consumption of the compressor. The improved efficiency of the refrigerant system not only reduces energy consumption but can lead to a reduced evaporator size while still providing the same performance both in terms of capacity and coefficient of performance. A smaller evaporator is advantageous as space is a premium within the vehicle and specifically underneath the instrument panel.

In order to address the mal-distribution problem described above, prior art evaporators have utilized a four pass refrigerant flow configuration. While the four pass configuration minimizes the mal-distribution of the refrigerant in the evaporator, this four pass configuration increases the pressure drop across the evaporator core due to the increased velocity of the refrigerant and superheated refrigerant expanding towards the latter part of the evaporator. Furthermore, one half of the core is in parallel flow and the other half is in counter-flow with respect to the ambient air flow direction through the heat exchanger. A counter-flow circuit has a better heat transfer rate than a parallel flow circuit.

Therefore, what is needed is a new and improved evaporator design which corrects the mal-distribution problem described above while providing a low pressure drop across the evaporator core and a counter-flow circuitry.

SUMMARY

In an aspect of the present invention, an evaporator for exchanging heat between a refrigerant and ambient air is provided. The evaporator includes a plurality of refrigerant tubes at least two header tanks in fluid communication with the plurality of refrigerant tubes.

In another aspect of the present invention at least one of the heater tanks has a plurality of perforations through which refrigerant flows into each of the plurality of refrigerant tubes and a plurality of fins dispersed between each of the plurality of refrigerant tubes.

In yet another aspect of the present invention each of the plurality of refrigerant tubes are formed in a U-shape and includes at least one of the header tanks having an inlet for receiving refrigerant into the evaporator and at least one of the header tanks having an outlet for expelling refrigerant from the evaporator.

In yet another aspect of the present invention the perforations in the distribution tube has slots/perforations and the slots/perforations in the distribution tube that is disposed in the header tank have varying depth.

In still another aspect of the present invention the slot in a center of the header tank has the largest depth and the depth of the slots progressively decreases moving from the center toward the end of the header tank.

In yet another aspect of the present invention the slot/perforation has depth arrangement in accordance with that shown in FIG. 6.

In yet another aspect of the present invention the distribution tube can be rotated between −35 degrees and +35 degrees from a vertical position without degrading the evaporator's performance.

In yet another aspect of the present invention a plurality of internal turbulators are formed from a piercing operation. The turbulators turbulate (produce turbulent flow) the two phase flow and directs the flow through the slots/perforations located in the beginning and middle of the distribution tube. Without these turbulators, two phase refrigerant will flow to the bottom of the tube first and then to the rest of the perforations causing mal-distribution.

These and other aspects and advantages of the present invention will become apparent upon reading the following detailed description of the invention in combination with the accompanying drawings.

DETAILED DESCRIPTION

Figure 1:
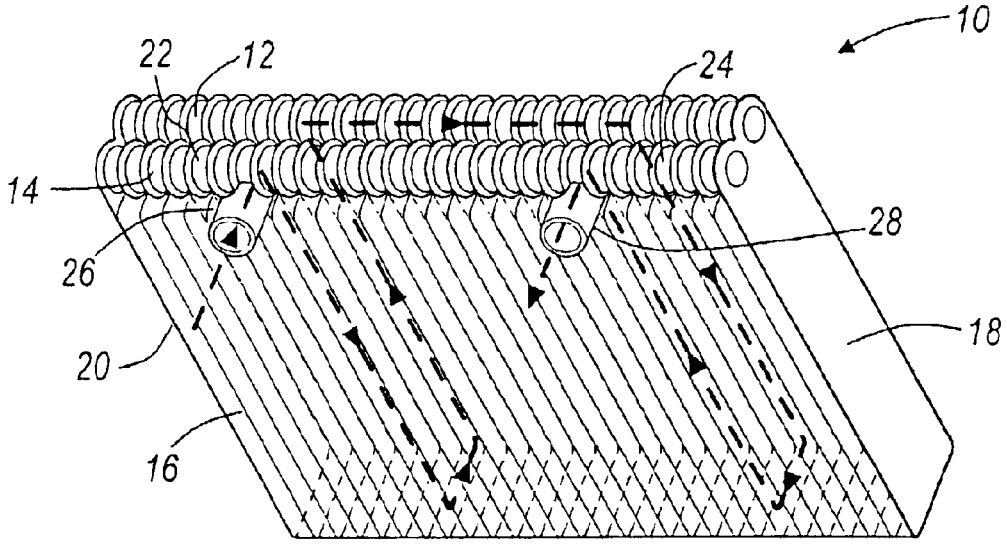
FIGURE - 1 (PRIOR ART)
FIG. 1 is a perspective view of a four pass evaporator.

Referring now to FIG. 1, a conventional evaporator 10 is illustrated. Evaporator 10 includes two header tanks 12 and 14, a plurality of refrigerant tubes 16, a plurality of fins 18, and side plates 19 and 20. Typically, these components are affixed using conventional brazing techniques. Generally, the fins are disposed between the refrigerant tubes to facilitate heat dissipation. Each of the refrigerant tubes define a U-shaped flow path for the refrigerant. The two ends of the U-shaped path are connected to header tanks 12 and 14. Tank 14 is divided into two subtanks 22 and 24 by a partition (not shown). An inlet pipe 26 communicates with subtank 22 and an outlet pipe 28 communicates with the subtank 24.

Figure 2:
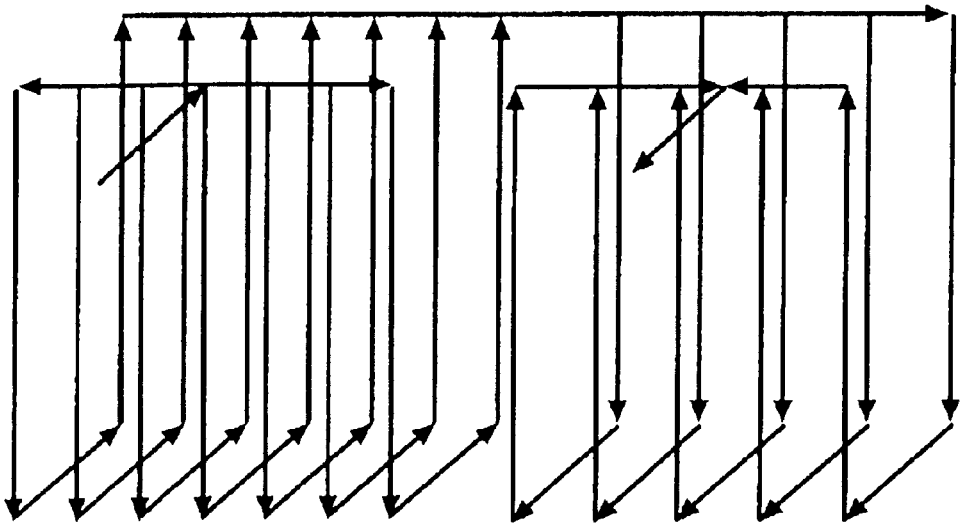
FIG. 2 is a schematic diagram illustrating the flow path of the four pass evaporator of FIG. 1.

Referring now to FIG. 2, a schematic diagram illustrating a flow path of the refrigerant in evaporator 10, in accordance with the prior art. The mode of refrigerant flow in FIG. 2 is referred to in the art as four path flow. As shown, refrigerant enters at one end of the evaporator and flows in a U-shape until it reaches the other header tank where the refrigerant flows again in a U-shaped flow pattern until it exits through the outlet. This prior art flow configuration has an improved refrigerant distribution characteristic over other designs. However, the four path flow evaporator has a higher refrigerant pressure drop across the evaporation core due to the higher refrigerant velocity. Conventional two path evaporators, experience uneven temperature distribution over the surface of the refrigerant tubes when the refrigerant circuit is operating due to the mal-distribution of the two phase refrigerant. Mal-distribution of the refrigerant occurs in a two path flow evaporator without a distributor tube because each refrigerant tube sees a varying pressure differential depending on its location from the inlet and outlet tubes. For example, refrigerant tubes closest to inlet/outlet tubes will have the highest pressure differential and therefore see most of the refrigerant flow while the refrigerant tubes farthest from inlet/outlet tubes will have the lowest refrigerant flow. The temperature difference between refrigerant tubes may be several degrees.

Figure 3:
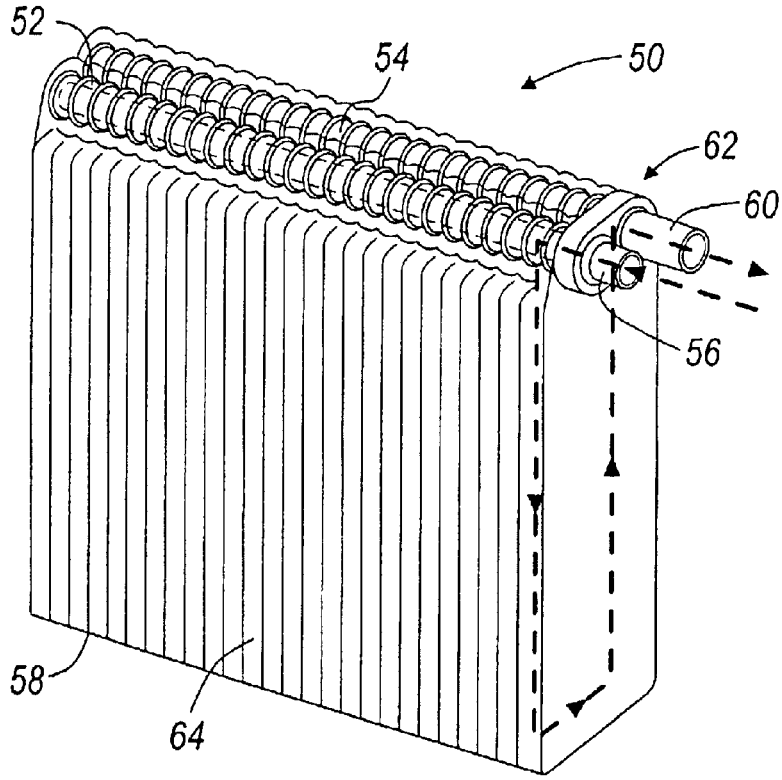
FIG. 3 is a perspective view of a two pass evaporator having a side inlet and side outlet, in accordance with the present invention.

Referring now to FIG. 3, a two path flow evaporator is illustrated, in accordance with the present invention. Evaporator 50 has two header tanks 52 and 54. Header tank 52 is in communication with an inlet 56 and with refrigerant tubes 58. Header tank 54 is in communication with an outlet 60 and the refrigerant tubes 56. More specifically, refrigerant tubes 58 are substantially U-shaped and are connected at one end to header tank 52 and at the other end to header tank 54. As illustrated, the inlet 56 and outlet 50 are disposed at an end 62 of evaporation 50. In operation, refrigerant is received in inlet 56 into header tank 52 and then through predominantly U-shaped refrigerant tubes 58 to header tank 54. Header tank 54 empties refrigerant through outlet 60. Additionally, a plurality of heat dissipation fins 64 are disposed between the U-shaped refrigerant tubes 58 to facilitate heat exchange between the refrigerant and the ambient air.

Figure 4:
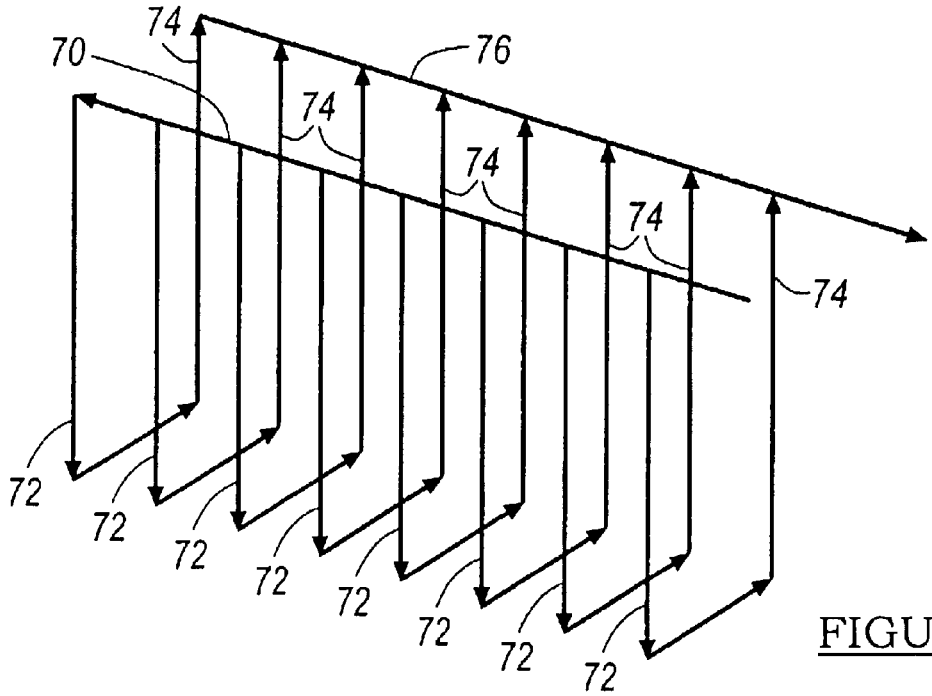
FIG. 4 is a schematic diagram of the refrigerant flow path of the evaporator of FIG. 3.

Referring now to FIG. 4, a schematic diagram illustrating the flow path of refrigerant through evaporator 50, in accordance with the present invention. Refrigerant enters evaporator 50 at inlet 56 and flows within header tank 52 along a flow path indicated by arrow 70 where it is distributed to each of the refrigerant tubes, as indicated by arrows 72. The refrigerant then enters header tank 54 as indicated by arrows 74 and flows through header tank 54 to outlet 60, as indicated by arrow 76. The refrigerant exists in two phases, a liquid and a vapor phase. The flow velocities of the refrigerant in each of the refrigerant tubes are about equal. The result is that an imbalance in the mass flow rate in the refrigerant tubes corresponding to the distance from the inlet pipe causes reduced refrigerant in several of the refrigerant tubes. The refrigerant tubes having the highest mass flow rate have a higher refrigerant coefficient as compared to the refrigerant tubes having a lower mass flow rate. This phenomenon is well known in the field of heat exchangers.

Figure 5A:
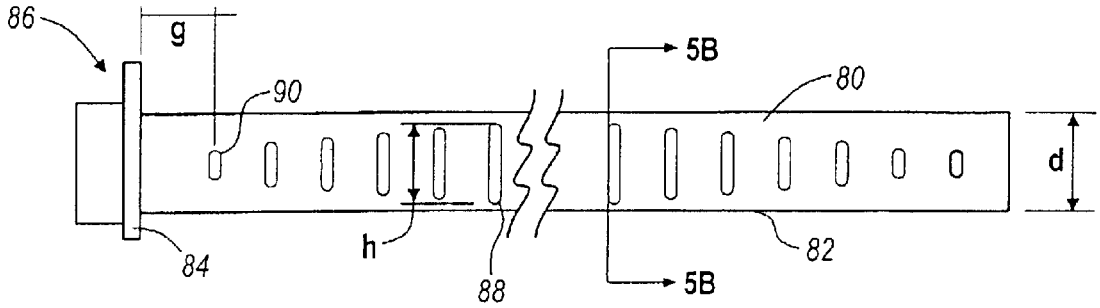
FIGS. 5*a*, 5*b* and 5*c* are top, cross-sectional and perspective views of a flow distributor, in accordance with the present invention.

Referring now to FIG. 5*a*, a plan view illustration of a flow distributor 80, in accordance with the present invention. Flow distributor 80 has a generally elongated tubular body 82 having a diameter "D" that is sized for receipt into inlet 56 of evaporator 50. A flange 84 is affixed to end 86 of the tubular body 82. Flange 84, as will become clear, acts to regulate the insertion depth of tubular body 82 through inlet 56 into header tank 52.

A plurality of spaced perforations or slots 88 are disposed along tubular body 82. A spacing of dimension "S" from the first slot 90 is defined such that slot 90 aligns with the first refrigerant tube 58. The spacing of each of the other perforations from slot 90 is such that each perforation aligns with each of the refrigerant tubes 58 of evaporator 50. The sizing of each of the perforations 86 along tubular body 82 are configured such that a uniform distribution of the liquid and vapor phases of the refrigerant is achieved through evaporator 50. For example, the depth (which controls the overall opening) of the perforations 88 are varied such that the perforations at a center portion 92 of tubular body 82 are larger than at the ends of the tubular body 82. In other words, the depth of each of the perforations are largest at the center of the tubular body 82 and progressively decrease towards the ends of tubular body 82.

Figure 5B:
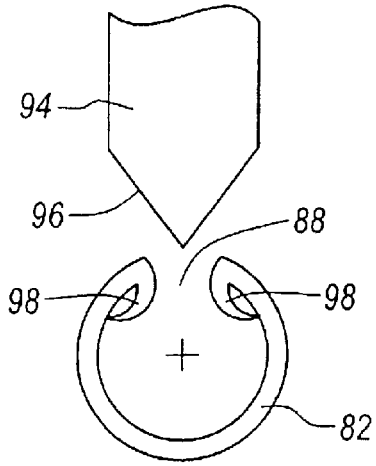

As illustrated in FIG. 5*b* in a cross-sectional view through tubular body 82, at a point indicated in FIG. 5*a*, perforation 86 may be achieved using a cutting tool 94 having a tapered blade 96. The depth of the perforation would be controlled by the distance cutting tool 94 travels into tubular body 82. A pair of internal turbulators 98 are formed at each perforation 88 each time cutting tool 94 pierces tubular body 82. The turbulators 98 turbulate (produce turbulent flow) the two phase flow and directs the flow through the slots/perforations located in the beginning and middle of distribution tube 80. Without these turbulators 98, two phase refrigerant will flow to the bottom of the tube first and then to the rest of the perforations causing mal-distribution.

Figure 5C:
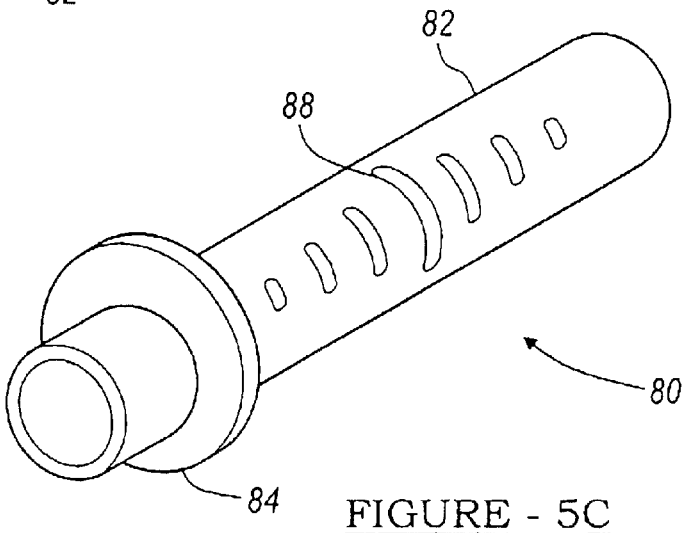

Referring now to FIG. 5*c*, a perspective view of flow distributor 80 is further illustrated, in accordance with the present invention. Flow distributor 80 achieves a uniform two-phase refrigerant distribution through the refrigerant tubes of evaporator 50 by providing a plurality of slots or perforations along tubular body 82 having varied depths or sizes. Further, the spacing between the perforations or slot is such that each slot 88 is aligned with each refrigerant tube 58 within evaporator 50.

Figure 6:
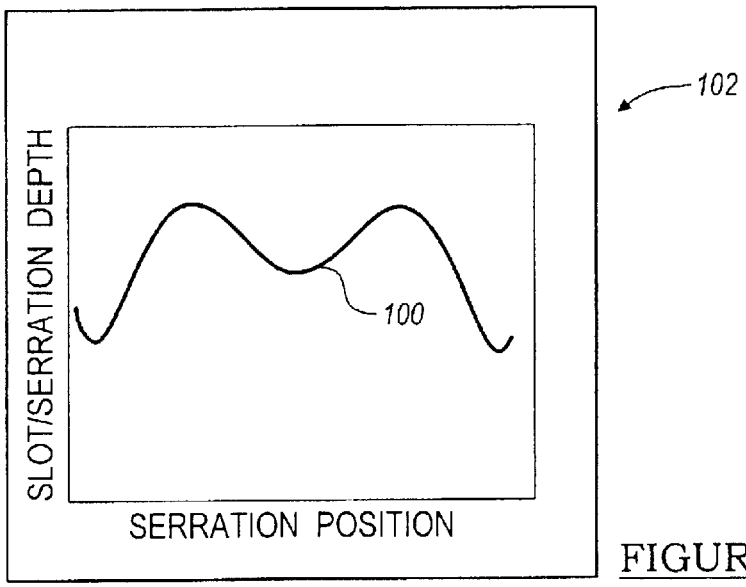
FIG. 6 is a chart illustrating a perforation depth versus perforation location along the tube, in accordance with the present invention.

In an alternative embodiment, the depth of each of the perforations vary in accordance with a relationship 100 shown chart 102 of FIG. 6. As chart 102 illustrates, the depth (or size) of the perforations vary from one end of tubular body 82 to the other end according to relationship 100. Relationship 100 varies as a function of perforation position along the tubular body.

Figure 7A:
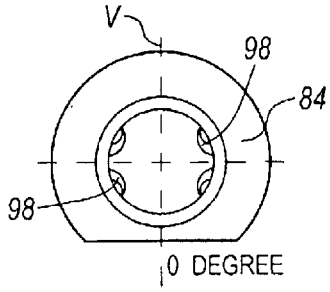
FIGS. 7*a*, 7*b*, and 7*c* are an end views of the distributor tube angular insertion into the inlet of the evaporator, in accordance with the present invention.
Figure 7B:
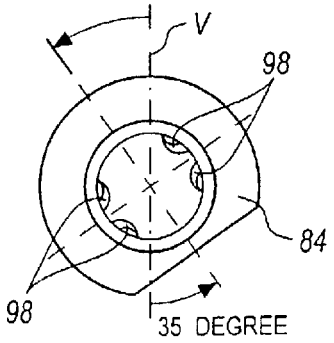
Figure 7C:
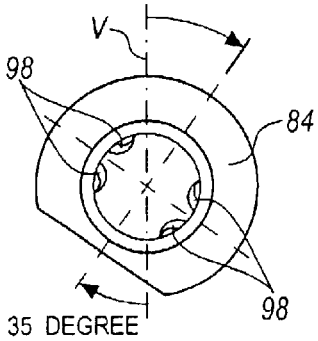

Referring now to FIGS. 7*a*, 7*b*, and 7*c* end views of flow distributor tube 80 are illustrated. Distributor tube 80 may be inserted into inlet 56 of evaporator 50 (shown in FIG. 3) at an angle between minus 35 degrees and plus 35 degrees with respect to a vertical line "v". FIG. 7*a* illustrates distributor tube 80 rotated by zero degrees with respect to vertical line "v". FIG. 7*b* illustrates distributor tube 80 rotated by minus 35 degrees with respect to vertical line "v". FIG. 7*c* illustrates distributor tube 80 rotated by plus 35 degrees with respect to vertical line "v". Thus, any rotation between the angles specified above is preferable and will produce a desired refrigerant flow distribution through the evaporator.

In an alternate embodiment of an integrated flow distributor is provided. In other words, the present invention contemplates integrating the slots or perforations into header tank 52 as an alternative to flow distributor 80. Accordingly, the perforations would be spaced and sized to achieve uniform refrigerant distribution through the refrigerant tubes as previously described.

As any person skilled in the art of heat exchanger design will recognize from the previous detailed description and from the figures and claims, modifications and changes can be made to the preferred embodiments of the invention without departing from the scope of this invention defined in the following claims.

What is claimed is:

1. A heat exchanger device for exchanging heat between a refrigerant and ambient air, the heat exchanger device comprising:

a plurality of refrigerant tubes for receiving and circulating the refrigerant;

at least two header tanks in fluid communication with the plurality of refrigerant tubes;

a distribution tube disposed within an inlet of the at least one of the at least two header tanks, wherein the distribution tube has a plurality of perforations through which refrigerant flows into each of the plurality of refrigerant tubes;

a plurality of internal turbulators formed in the distribution tube; and a plurality of fins dispersed between each of the plurality of refrigerant tubes.

2. The device of claim 1 wherein each of the plurality of refrigerant tubes are formed in a U-shape.

3. The device of claim 1 wherein the inlet receives the refrigerant.

4. The device of claim 1 wherein the other of the at least two header tanks has an outlet for expelling refrigerant from the evaporator.

5. The device of claim 1 wherein the perforations are slots.

6. The device of claim 5 wherein the slots in the distribution tube have a varying depth.

7. The device of claim 5 wherein the slot in a center of the distribution tube has the largest depth and the depth of the slots progressively decreases moving from the center toward an end of the distribution tube.

8. The device of claim 5 wherein a depth of the slot follows a predefined relationship, wherein the relationship is a function of a slot position along the distribution tube.

9. A device for exchanging heat between a refrigerant and ambient air, the device comprising:

a plurality of refrigerant tubes;

at least two header tanks in fluid communication with the plurality of refrigerant tubes;

a distribution tube disposed within an inlet of at least one of the at least two header tanks, the tube having a plurality of slots for distributing refrigerant from the header tank to each of the refrigerant tubes, and wherein the slot in a center of the distribution tube has the largest depth and the depth of the slots progressively decreases moving from the center to the end of the distribution tube; and a plurality of internal turbulators formed in the distribution tube to produce turbulent flow of the refrigerant.

10. The device of claim 9 wherein each of the plurality of refrigerant tubes are formed in a U-shape.

11. The device of claim 9 wherein the inlet of the at least two header tanks has an inlet for receiving refrigerant into the evaporator.

12. The device of claim 9 wherein at least one of the header tanks has an outlet for expelling refrigerant from the evaporator.

13. The device of claim 9 where the distributor tube is inserted horizontally with respect to a vertical reference line in at least one of the at least two header tanks and turned with respect to the vertical reference line at an angle between plus and minus 35 degrees.

* * * * *